US005565064A

United States Patent [19]

Grimm et al.

[11] Patent Number: 5,565,064

[45] Date of Patent: Oct. 15, 1996

[54] PAPER MACHINE WET FORMING SECTION AND METHOD OF OPERATION THEREOF

[75] Inventors: Helmut Grimm, Ellwangen; Douglas Miller, Königsbronn, both of Germany

[73] Assignee: J.M. Voith GmbH, Heidenheim, Germany

[21] Appl. No.: 294,561

[22] Filed: Aug. 23, 1994

[30] Foreign Application Priority Data

Aug. 28, 1993 [DE] Germany ..... 43 28 997.5

[51] Int. Cl.[6] ..... D21F 1/02

[52] U.S. Cl. ..... 162/216; 162/336; 162/347; 162/212; 162/203

[58] Field of Search ..... 162/341, 336, 162/343, 347, 338, 339, 216, 212, 352, 300, 301, 315, 318, 203, 272

[56] References Cited

U.S. PATENT DOCUMENTS

| | | | |
|---|---|---|---|
| 1,928,107 | 9/1933 | Lang | 162/212 |
| 3,726,758 | 4/1973 | Parker et al. | 162/299 |
| 3,944,465 | 3/1976 | Wolf | 162/336 |
| 3,997,390 | 12/1976 | Kankaanpaa | 162/132 |
| 4,240,872 | 12/1980 | Wahren | 162/344 |
| 4,790,909 | 12/1988 | Harwood | 162/301 |

FOREIGN PATENT DOCUMENTS

WO81/02903 10/1981 WIPO .

OTHER PUBLICATIONS

Voith Drawing entitled "Duoformer CF" (not dated).
Voith Drawing entitled "Duoformer CFV" (not dated).

*Primary Examiner*—Donald E. Czaja
*Assistant Examiner*—Calvin Padgett
*Attorney, Agent, or Firm*—Marshall, O'Toole, Gerstein, Murray & Borun

[57] ABSTRACT

In order to independently influence the dewatering performance of a wet forming section of a paper machine as well as the quality of a web produced by the machine, a paper machine head box is mounted on a swiveling device adapted to move a nozzle of the head box around a periphery of a forming cylinder. Two continuous-loop forming wires wrap about the forming cylinder and pulp is discharged through the nozzle into a gap formed by the two wires. A method of operation of the wet forming section includes the step of swiveling both the head box nozzle and an inlet roll (upon which one of the wires is wrapped) around the forming cylinder in a circular arc.

19 Claims, 2 Drawing Sheets

PAPER MACHINE WET FORMING SECTION AND METHOD OF OPERATION THEREOF

BACKGROUND OF THE INVENTION

1. Field of the Invention

The invention relates to paper machines and in particular to a wet forming section of a paper machine and the operation thereof.

2. Description of Related Technology

A paper machine wet forming section having a head box with at least one nozzle for discharging pulp in a jet in a width approximately equal to the width of the machine is known in the art. Such a machine may include a forming cylinder disposed downstream of the head box with respect to the direction of conveyance of the paper pulp through the machine and two continuous-loop forming wires, each wire wrapping about a selected peripheral portion of the forming cylinder, the wires forming a wedge-shaped inlet gap for receiving a jet stream of pulp from the head box nozzle. Such a machine may further include a plurality of guide rolls, one of which being an inlet guide roll around which one of the forming wires is wrapped. It is known to include a displacement device adapted to change the position of the inlet guide roll in order to change the location or length of the peripheral portion of the forming cylinder wrapped by both of the forming wires.

A paper machine twin-wire web forming system disclosed in Parker et al., U.S. Pat. No. 3,726,758 (Apr. 10, 1973) includes a wedge-shaped inlet gap or nip defined by two continuous-loop forming wires. A pulp jet stream is discharged from a nozzle of a head box into the wedge-shaped gap. FIG. 2 of the Parker et al. patent shows such a device in which the extent that one of the forming wires wraps about a forming cylinder can be altered, as well as the angle the pulp jet is directed to the inlet gap. When the nozzle of the head box is directed appropriately, the pulp jet can be injected either exactly in the middle of the inlet gap, or it can deviate so that the jet stream selectively impinges one or the other wire. As a result, a preliminary dewatering of the pulp occurs on the impinged wire before dewatering is performed between the two wires. The swiveling of the nozzle of the head box serves to continuously change the angle of the pulp jet stream.

Wolf, U.S. Pat. No. 3,944,465 (Mar. 16, 1976) discloses a head box for a paper machine forming section having only a single continuous-loop forming wire or screen. With reference to a side view thereof, the head box swivels in such a way that an opening of a nozzle of the head box moves along a circular arc when the head box is swiveled. The circular arc has a curvature opposite to that of a surface of a breast roll around which the wire is wrapped. The angle of a pulp jet discharged from the nozzle opening can therefore be continuously changed so that the pulp jet stream leaving the nozzle will be discharged either parallel to the wire or impinge the wire at an acute angle. If necessary, the stream is directed upwardly at an acute angle so that the jet is a parabolic trajectory.

Both the Parker et al. and Wolf patents disclose ways of influencing dewatering in the first phase of sheet formation. However, such devices have not proved satisfactory as they have been found to also alter the quality of the paper web formed.

SUMMARY OF THE INVENTION

It is an object of the invention to overcome one or more of the problems described above. It is also an object of the invention to provide a wet end forming device wherein dewatering on a forming roll can be selectively altered without sacrificing the quality of the fiber web produced.

According to the invention, a paper machine forming section is provided that includes a head box having at least one nozzle for discharging pulp in a jet having a width approximately equal to the width of the machine. The forming section also includes a forming cylinder disposed downstream of the head box with respect to the direction of conveyance of the paper pulp through the machine and two continuous-loop forming wires, each wire wrapping about a selected peripheral portion of the forming cylinder. The two forming wires define a wedge-shaped inlet gap for receiving a jet stream of pulp from an opening of the nozzle. The forming section further includes a plurality of guide rolls, one of which is an inlet guide roll. One of the forming wires wraps about a periphery of the inlet guide roll. A displacement device is adapted to change the position of the inlet guide roll in order to change the location and/or the length of the peripheral portion of the forming cylinder wrapped about by both of the forming wires. The forming section according to the invention also includes a swiveling device adapted to swivel the head box and thus move the nozzle opening a large extent about the periphery of the forming cylinder.

The invention further includes a method of operation of the paper machine forming section which includes swiveling the inlet roll and the nozzle opening of the head box around a periphery of the forming cylinder to change the location and/or the length of the peripheral portion of the forming cylinder wrapped about by both of the forming wires.

Other objects and advantages of the invention will be apparent to those skilled in the art from the following detailed description taken in conjunction with the drawings and the appended claims.

DETAILED DESCRIPTION OF THE INVENTION

According to the invention, a paper machine head box swiveling device is designed and disposed in such a way that a head box nozzle opening can be moved to a large extent around the periphery of the forming cylinder. A "large extent" is defined herein to mean that the swiveling encompasses not only a few degrees but, for example, the swiveling possibility ranges up to about 40° C. around the periphery of the forming cylinder.

The nozzle opening can be moved around in an arc, the swiveling mid-point of which can be at least approximately coincident with the mid-point of the forming cylinder.

Figure 1:
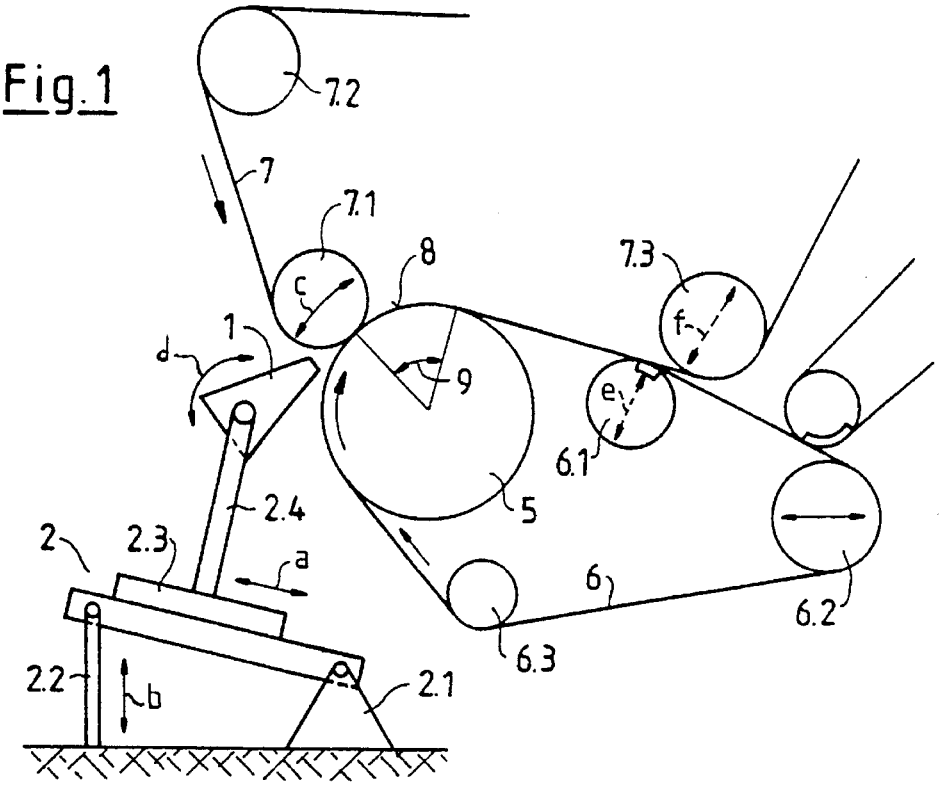
FIG. 1 is a is a schematic view of a paper machine wet forming section according to the invention.

With reference to FIG. 1, a head box nozzle body 1 (the remainder of the head box is not shown) is pivotally mounted on a rocker generally designated 2. The rocker has a fixed base 2.1, a telescoping support 2.2, a guide shoe 2.3 and a support 2.4. The arrows a and b indicate possible shifting and swiveling directions of the rocker 2.

Downstream of the head box nozzle body 1 with respect to the direction of pulp flow out of the head box is a twin-wire forming system. The system includes a forming cylinder 5 and two continuous-loop wires or screens 6 and 7. The wire 6 wraps about the forming cylinder 5, a suction guide roll 6.1, a deflecting roll 6.2, which also serves as a tension guide roll, and a guide roll 6.3. The wire 7 wraps about the forming cylinder 5 and a number of guide rolls including an inlet guide roll 7.1, and guide rolls 7.2 and 7.3.

The wires 6 and 7 both wrap about the forming cylinder 5 at a selected peripheral section thereof. This selected section may be identified as an "envelope section" 8. The envelope section 8 forms an arc corresponding to an angle 9.

The size and, if desired, the location of the envelope section 8 can be varied. To increase the size of the envelope section 8 in the direction of the head box, the inlet roll 7.1 can be moved toward the head box along the curved double arrow c, i.e., in a circular arc around the forming cylinder 5. This is accomplished by mounting the inlet roll 7.1 on a rocker (not shown) having a sliding guide (not shown). At the same time, the head box nozzle body 1 is brought into a corresponding position. For example, the length of the telescoping support 2.2 may be reduced, the guide shoe 2.3 moved in the corresponding direction, and the nozzle body 1 swiveled in the direction of the arc-shaped double arrow d in such a way that the jet of pulp leaving the nozzle has a desired direction and length to result in the jet impinging exactly at an apex of a wedge-shaped inlet gap formed by the two wires 6 and 7, or at a slight angle of inclination thereto.

The position of the guide rolls 6.1 and 7.3 can also be altered, if desired, corresponding to the dashed double arrows e and f, respectively. In this way, the position of the starting point of the two wires 6 and 7 from the periphery of the forming cylinder 5 can be altered so that the length of the envelope section 8 can be influenced.

The invention also includes a method of operation of the inventive paper machine forming section wherein the nozzle opening of the head box is swiveled in such a manner that the length of the pulp jet remains almost constant with respect to the various swiveling positions of the head box. Furthermore, the nozzle opening may be swiveled such that the pulp jet impinges a forming wire (or wires) at a constant point or line, requiring the discharge of pulp at various impinging angles. Alternatively, the nozzle opening may be swiveled such that the pulp jet impinges a forming wire (or wires) at a constant angle, but at different impingement points or lines.

Figure 2:
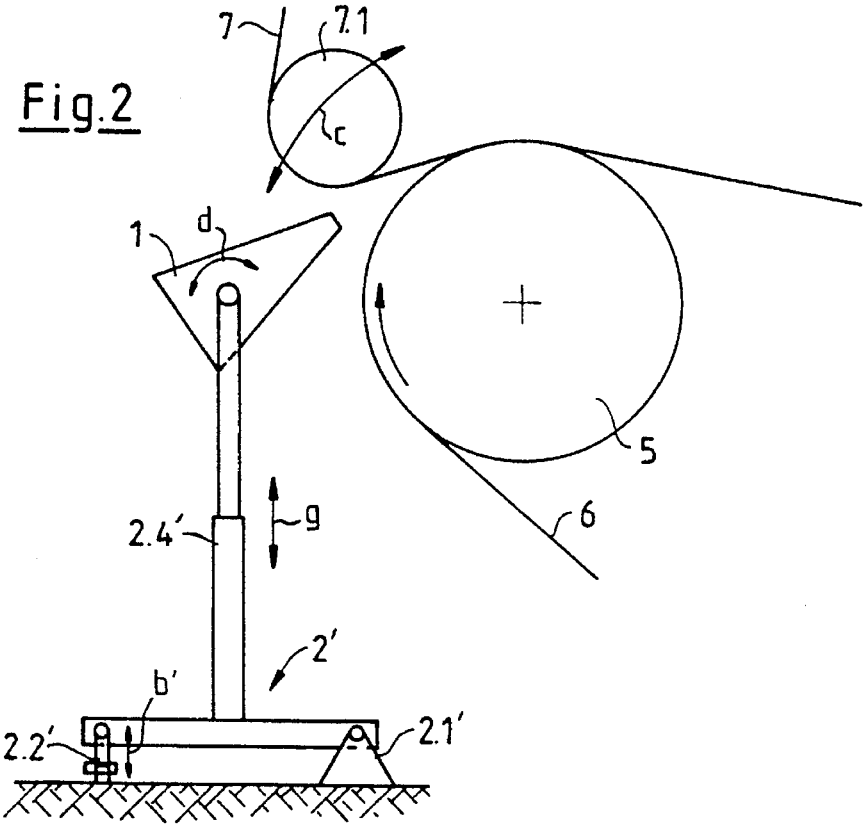
FIG. 2 is a schematic view of a second embodiment of a paper machine wet forming section according to the invention.

Another embodiment of a paper machine according to the invention is shown in FIG. 2. The embodiment shown in FIG. 2 is identical to that of FIG. 1 with the exception of a rocker generally designated 2' which includes a fixed base 2.1', a telescoping support 2.2' which may be lengthened or shortened in the directions shown by a double arrow b', and a support 2.4' which is also telescoping by lengthening or shortening the support 2.4' in the directions shown by a double arrow g (the guide shoe 2.3 of FIG. 1 is absent). Although the twin-wire forming section shown in FIG. 2 is identical to that of FIG. 1, it is noted that other twin-wire designs or configurations may be utilized.

Figure 5:
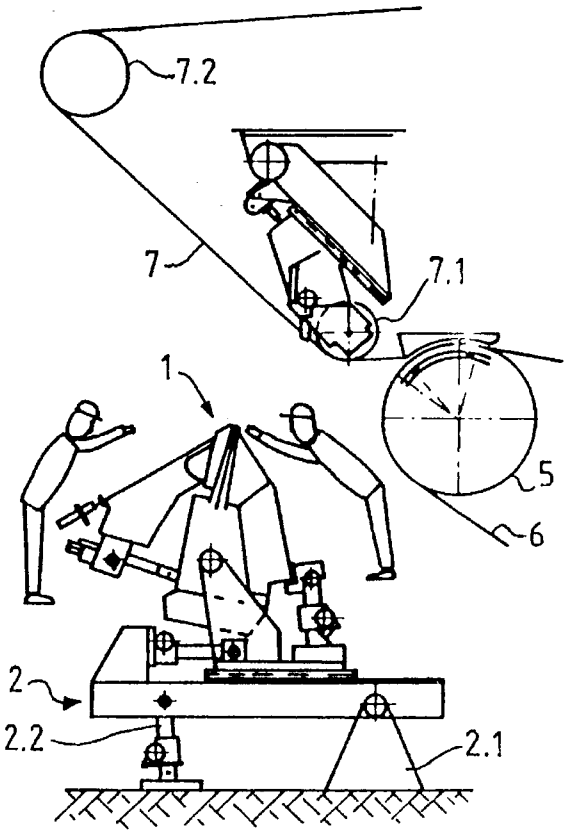
FIG. 5 is a partially schematic view of the forming section of FIG. 1 shown tipped to allow for maintenance.
Figure 4:
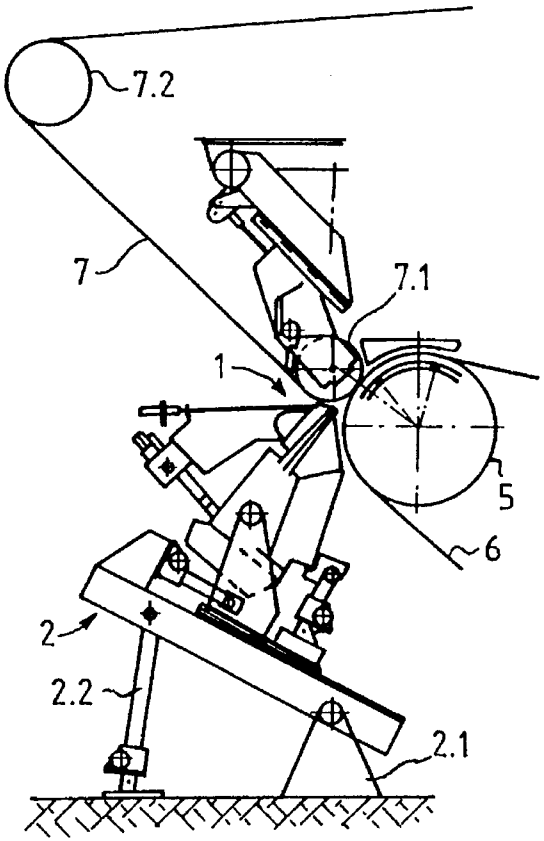
FIG. 4 is a partially schematic view of the forming section of FIG. 1 shown in an alternative position.
Figure 3:
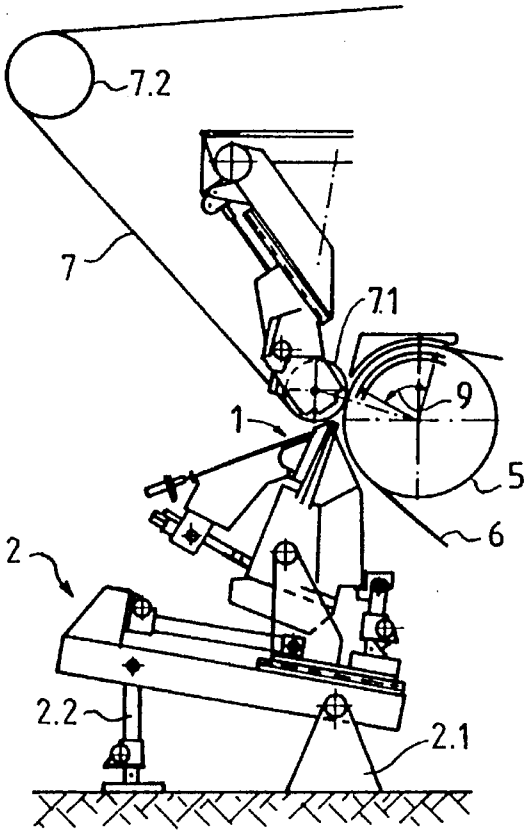
FIG. 3 is a partially schematic view of the paper machine wet forming section of FIG. 1.

More detailed views of the embodiment of a wet end forming section of FIG.1 are shown in FIGS. 3–5. Due to the position of the guide roll 7.1 and the head box nozzle 1, the forming angle 9 in the mode of operation shown in FIG. 3 is approximately 80°C., and in the mode of operation shown in FIG. 4 is approximately 60°C. Other angle settings are also possible depending on the desired dewatering performance.

FIG. 5 illustrates that the entire head box can be tipped away from the wires 6 and 7 with the aid of the rocker 2 so that operations such as head box cleaning and wire installation can be performed without hindrance.

Some advantages of wet end forming sections according to the invention are summarized below:

rough adjustment of the forming angle;

fine adjustment of the point of impingement of a pulp jet onto a forming wire at a constant angle of impingement;

fine adjustment of the angle of the pulp jet when a constant point of impingement on a forming wire is desired;

fine adjustment of the free length of the pulp jet; and ready movement of the head box into a position where it is easily accessible for cleaning and maintenance (FIG. 5).

When operating a paper machine forming section according to the invention, it may be necessary to make some adjustments in the size of the vacuum zone in the area including the forming cylinder periphery and the forming angle (i.e., in the vicinity of the roll gap formed by the wires 6 and 7). The size of the vacuum zone is determined by two sealing strips (not shown in the drawings). The first strip is disposed at approximately the point of impingement of a pulp jet from the head box onto the forming wires. The second strip is disposed at a point where the forming wires leave the forming roll.

There are two adjustment options to consider. In the first option, the vacuum in the zone is kept constant and is adapted to the smallest possible forming angle. With such an option, rebuilding of the forming cylinder is not necessary. At a large forming angle, the initial region of the formation zone of the forming cylinder is not aspirated, i.e., dewatering occurs in this area only by the pressure of the wire and centrifugal force.

In a second option, the vacuum zone is adapted to the particular forming angle. Thus, the first sealing strip is always shifted to a position where the jet impinges a forming wire. Thus, optimal utilization of the vacuum zone is ensured.

Other machine adaptations that may be desirable when utilizing a device and method of the invention include providing various jet channel guide plates for various forming angles. Alternatively, T-grooves could be utilized. Also, the pulp distributor tube of the head box (or distributor tubes of a multi-layer head box) can be fixedly mounted whereas the inlet can consist of flexible elements (for example, tubings) which can easily adapt to the swiveling of the head box. Alternatively, distributor tubes could be disposed on the rocker with a flexible element per distributor tube disposed between the fixed and movable parts of the machine. Also, pulp could be introduced via a central distributor.

The foregoing detailed description is given for clearness of understanding only, and no unnecessary limitations should be understood therefrom, as modifications within the scope of the invention will be apparent to those skilled in the art.

We claim:

1. A paper machine forming section comprising:

a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device for swiveling the head box about a horizontal axis, said swiveling device being adapted to move the opening of the at least one nozzle to a large extent about the periphery of the forming cylinder, said inlet guide roll displaceable from a first roll position to a second roll position along the periphery of the forming cylinder in a direction and at a distance corresponding to the swiveling movement of the head box from a first head box position to a second head box position, respectively, along the periphery of the forming cylinder, said swiveling device further comprising a rocker pivotally mounted on first and second supports and having a third support linking the rocker to the head box, the third support being mounted on the rocker and the head box being suitably mounted on the third support, at least one of the first and second supports having a height that is adjustable, the at least one nozzle being displaceable with respect to the rocker.

2. The forming section of claim 1 wherein the opening of the at least one nozzle can be moved around in an arc, the swiveling mid-point of which being at least approximately coincident with the mid-point of the forming cylinder.

3. The paper machine of claim 2 wherein the head box can be moved parallel to the rocker.

4. The paper machine of claim 2 wherein the distance between the head box and the rocker is adjustable.

5. The paper machine of claim 2 wherein the head box can be swiveled around an axis parallel to an axis of the forming cylinder.

6. The paper machine of claim 2 wherein the head box can be swiveled about its own axis.

7. A paper machine forming section comprising:

a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device for changing the position of the inlet guide roll in order to change at least one of the location and length of the peripheral portion of the forming cylinder wrapped about by both of the forming wires;

a swiveling device for swiveling the head box about a horizontal axis, said swiveling device comprising a rocker pivotally mounted on first and second supports, at least one of the first and second supports having a height that is adjustable, the swiveling device further comprising a third support linking the rocker to the head box, the third support being mounted on the rocker and the head box being pivotally mounted on the third support wherein the at least one nozzle is displaceable with respect to the rocker.

8. The paper machine of claim 7 wherein the head box can be moved parallel to the rocker.

9. The paper machine of claim 7 wherein the distance between the head box and the rocker is adjustable.

10. The paper machine of claim 7 wherein the third support is a telescoping support.

11. The paper machine of claim 7 wherein the head box can be swiveled around an axis parallel to an axis of the forming cylinder.

12. The paper machine of claim 7 wherein the head box can be swiveled about its own axis.

13. A method of operating a paper machine comprising the steps of:

(a) providing a paper machine comprising a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device adapted to swivel the head box, said swiveling device adapted to move the at least one nozzle opening to a large extent about the periphery of the forming cylinder, said swiveling device comprising a rocker pivotally mounted on first and second supports, at least one of the first and second supports having a height that is adjustable, the swiveling device further comprising a third support linking the rocker to the head box, the third support being mounted on the rocker and the head box being pivotally mounted on the third support wherein the at least one nozzle is displaceable with respect to the rocker; and (b) swiveling the inlet roll and the nozzle opening of the head box in tandem from a first location along a periphery of the forming cylinder to a second location along the forming cylinder periphery to change at least one of the location and the length of the peripheral portion of the forming cylinder wrapped about by both of the forming wires.

14. The method of claim 13 comprising the step of swiveling the inlet roll and the opening of the at least one nozzle at least approximately in a circular arc about the periphery of the forming cylinder.

15. A method of operating a paper machine comprising the steps of:

(a) providing a paper machine comprising a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device adapted to swivel the head box, said swiveling device adapted to move the at least one nozzle opening to a large extent about the periphery of the forming cylinder;

(b) swiveling the inlet roll and the nozzle opening of the head box in tandem from a first location along a periphery of the forming cylinder to a second location along the forming cylinder periphery to change at least one of the location and the length of the peripheral portion of the forming cylinder wrapped about by both of the forming wires; and (c) swiveling the opening of the at least one nozzle of the head box in such a manner that the length of the produced pulp jet remains substantially constant with respect to various swiveling positions of the head box.

16. A method of operating a paper machine comprising the steps of:

(a) providing paper machine comprising a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device adapted to swivel the head box, said swiveling device adapted to move the at least one nozzle opening to a large extent about the periphery of the forming cylinder;

(b) swiveling the inlet roll and the nozzle opening of the head box in tandem from a first location along a periphery of the forming cylinder to a second location along the forming cylinder periphery to change at least one of the location and the length of the peripheral portion of the forming cylinder wrapped about by both of the forming wires; and (c) swiveling the opening of the at least one nozzle in such a manner that, in different head box swiveling positions, the pulp jet impinges one of the forming wires at various angles to maintain impingement at a constant point on the wire.

17. A method of operating a paper machine comprising the steps of:

(a) providing a paper machine comprising a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device adapted to swivel the head box, said swiveling device adapted to move the at least one nozzle opening to a large extent about the periphery of the forming cylinder;

(b) swiveling the inlet roll and the nozzle opening of the head box in tandem from a first location along a periphery of the forming cylinder to a second location along the forming cylinder periphery to change at least one of the location and the length of the peripheral portion of the forming cylinder wrapped about by both of the forming wires; and (c) swiveling the opening of the at least one nozzle in such a manner that, in different head box swiveling positions, the pulp jet impinges at least one of the forming wires at various angles to maintain impingement along a constant line on the wire.

18. A method of operating a paper machine comprising the steps of:

(a) providing a paper machine comprising a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device adapted to swivel the head box, said swiveling device adapted to move the at least one nozzle opening to a large extent about the periphery of the forming cylinder;

(b) swiveling the inlet roll and the nozzle opening of the head box in tandem from a first location along a periphery of the forming cylinder to a second location along the forming cylinder periphery to change at least one of the location and the length of the peripheral portion of the forming cylinder wrapped about by both of the forming wires; and (c) swiveling the opening of the at least one nozzle in such a manner that, in different head box swiveling positions, the pulp jet impinges at least one of the forming wires at a constant angle at various impingement points on the wire.

19. A method of operating a paper machine comprising the steps of:

(a) providing paper machine comprising a head box having at least one nozzle for discharging paper pulp in a jet having a width approximately equal to the width of the machine;

a forming cylinder disposed downstream of the head box with respect to the direction of conveyance of the paper pulp through the machine;

two continuous-loop forming wires, each wire wrapping about a selected peripheral portion of the forming cylinder, said wires together forming a wedge-shaped inlet gap for receiving a jet stream of pulp from an opening of the at least one nozzle;

a plurality of guide rolls, at least one of said guide rolls being an inlet guide roll wherein one of said forming wires wraps about a peripheral portion of said inlet guide roll;

a displacement device adapted to change the position of the inlet guide roll in order to change at least one of the location and length of the peripheral portion of the forming cylinder wrapped about by both of the forming wires;

a swiveling device adapted to swivel the head box, said swiveling device adapted to move the at least one nozzle opening to a large extent about the periphery of the forming cylinder;

(b) swiveling the inlet roll and the nozzle opening of the head box in tandem from a first location along a periphery of the forming cylinder to a second location along the forming cylinder periphery to change at least one of the location and the length of the peripheral portion of the forming cylinder wrapped about by both of the forming wires; and (c) swiveling the opening of the at least one nozzle in such a manner that, in different head box swiveling positions, the pulp jet impinges at least one of the forming wires at a constant angle at various impingement lines on the wire.

* * * * *